US008024994B2

(12) United States Patent
St. John et al.

(10) Patent No.: US 8,024,994 B2
(45) Date of Patent: Sep. 27, 2011

(54) DEMOLITION UTILITY TOOL

(75) Inventors: Robert St. John, Cheshire, CT (US); Karl Vanderbeek, New Haven, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 11/819,241

(22) Filed: Jun. 26, 2007

(65) Prior Publication Data

US 2009/0000039 A1 Jan. 1, 2009

(51) Int. Cl.
*B25D 1/00* (2006.01)
*B25B 13/02* (2006.01)
*B25B 23/18* (2006.01)

(52) U.S. Cl. ..... 81/22; 7/138; 7/146; 7/166; 362/120

(58) Field of Classification Search ..... 81/20–25; 7/146, 147, 143, 144, 138–140, 166; D8/75, D8/81; 362/119, 120
See application file for complete search history.

(56) References Cited

U.S. PATENT DOCUMENTS

| | | | | |
|---|---|---|---|---|
| 37,920 | A | 3/1863 | Penny | |
| 89,013 | A | 4/1869 | Blake | |
| 292,168 | A * | 1/1884 | Lytle | 7/138 |
| 439,336 | A | 10/1890 | Zitlow | |
| 486,300 | A | 11/1892 | Scheid | |
| 513,271 | A | 1/1894 | Matthews | |
| 563,848 | A | 7/1896 | Dunham | |
| 743,823 | A | 11/1903 | Bryar | |
| 845,975 | A | 3/1907 | Patterson | |
| 868,733 | A | 10/1907 | Walker | |
| 884,229 | A | 4/1908 | Sparks | |
| 914,199 | A | 3/1909 | Stiren | |
| 935,459 | A | 9/1909 | Carr | |
| 1,114,837 | A | 10/1914 | Wilson | |
| D55,792 | S * | 7/1920 | Hudgins | 7/166 |
| 1,469,472 | A | 11/1921 | Bangert | |

(Continued)

FOREIGN PATENT DOCUMENTS

CA 2 296 048 7/2001

(Continued)

OTHER PUBLICATIONS

European Search Report issued for European Patent Application No. 07251165.2-1262, dated Jul. 27, 2007.

(Continued)

*Primary Examiner* — Hadi Shakeri
(74) *Attorney, Agent, or Firm* — Pillsbury Winthrop Shaw Pittman LLP

(57) ABSTRACT

The invention provides a demolition utility tool that can be used in many ways for the demolition of materials and/or for the manipulation of clamps valves, nuts, or other hardware. The tool includes a handle having a head at one end. The head has a longitudinal central plane that bisects the head, a strike contact face, and toothed, stepped grasping jaws that accommodate multiple sizes of material. The demolition tool may include a fixed wrench element and/or a spanner wrench element on the head. The demolition tool may also include a bent end pry bar at a second end of the handle that is offset 90 degrees from the longitudinal central plane of the tool head enabling full range of motion without interfering with other tool functions. The bent end pry bar may include a slot between located between its forked end for manipulating gas shut-off valves.

13 Claims, 19 Drawing Sheets

U.S. PATENT DOCUMENTS

| | | | | | |
|---|---|---|---|---|---|
| 1,465,009 | A | | 8/1923 | Wasseth | |
| 1,472,517 | A | | 10/1923 | Fry | |
| 1,514,060 | A | | 11/1924 | McCallum | |
| 1,613,729 | A | | 1/1927 | Shearwood | |
| 1,689,685 | A | | 10/1928 | Reeves | |
| 1,763,353 | A | | 6/1930 | Heller | |
| 1,689,585 | A | | 1/1935 | Haschart | |
| D120,609 | S | * | 5/1940 | Arnsbarger | D8/76 |
| 2,239,719 | A | | 4/1941 | Jarrett | |
| 2,491,129 | A | | 12/1949 | Nieuwsma | |
| D164,705 | S | | 10/1951 | Moses | |
| 2,896,910 | A | | 7/1959 | Cooper et al. | |
| 2,937,004 | A | | 5/1960 | Striani | |
| D192,721 | S | | 5/1962 | Mills | |
| 3,134,574 | A | | 5/1964 | Reuterfors | |
| 3,219,316 | A | * | 11/1965 | Fried | 254/131 |
| 3,705,430 | A | * | 12/1972 | Ziaylek, Jr. | 7/147 |
| D226,162 | S | | 1/1973 | Ziaylek et al. | |
| 3,760,656 | A | | 9/1973 | Veach | |
| 4,028,757 | A | | 6/1977 | Young | |
| 4,039,140 | A | | 8/1977 | Pulliam | |
| 4,287,623 | A | * | 9/1981 | Tarran | 7/166 |
| 4,408,505 | A | | 10/1983 | Cook | |
| D271,275 | S | | 11/1983 | Richilano | |
| D274,032 | S | | 5/1984 | Lai | |
| 4,476,596 | A | | 10/1984 | Fortune | |
| 4,597,123 | A | | 7/1986 | Cobe, Jr. | 7/138 |
| D291,402 | S | | 8/1987 | Square | |
| D299,414 | S | * | 1/1989 | Bajza et al. | D8/105 |
| D300,111 | S | | 3/1989 | Square | |
| 4,826,136 | A | * | 5/1989 | Thomas | 254/25 |
| D318,211 | S | | 7/1991 | D'Onofrio | |
| 5,033,501 | A | | 7/1991 | Stehling | |
| 5,044,033 | A | | 9/1991 | Fosberg | |
| D337,492 | S | | 7/1993 | Ryan et al. | |
| 5,282,287 | A | | 2/1994 | Aube | |
| D351,326 | S | | 10/1994 | Schwengel | |
| D359,220 | S | | 6/1995 | Vinar | |
| 5,428,853 | A | | 7/1995 | Menke et al. | |
| 5,456,278 | A | * | 10/1995 | Morris et al. | 137/1 |
| D384,264 | S | | 9/1997 | Liou | |
| D388,303 | S | | 12/1997 | Berggren | |
| D390,082 | S | | 2/1998 | Higgs | |
| 5,768,956 | A | | 6/1998 | Coonrad | |
| 5,845,354 | A | | 12/1998 | Long et al. | |
| 5,850,650 | A | | 12/1998 | Karsnia | |
| D404,267 | S | | 1/1999 | Hedin | |
| 5,896,607 | A | | 4/1999 | Hagan | |
| D414,089 | S | | 9/1999 | Kuo-Chen | |
| D420,873 | S | | 2/2000 | Hsieh | |
| D422,860 | S | | 4/2000 | Vinar | D8/40 |
| 6,186,475 | B1 | | 2/2001 | Selepouchin | |
| 6,220,124 | B1 | | 4/2001 | Perkins | |
| D449,770 | S | | 10/2001 | Chen | |
| 6,298,754 | B1 | | 10/2001 | Brown | |
| 6,352,009 | B1 | | 3/2002 | Gaidjiergis | |
| 6,435,059 | B1 | | 8/2002 | Martinez | |
| 6,604,728 | B1 | | 8/2003 | Boydon | |
| 6,637,061 | B1 | | 10/2003 | Spracklin et al. | |
| D496,244 | S | | 9/2004 | Boydon | |
| D499,322 | S | | 12/2004 | Hung | |
| 6,899,001 | B1 | | 5/2005 | Sanders et al. | |
| D507,167 | S | | 7/2005 | Richardson | |
| 7,033,365 | B2 | * | 4/2006 | Powell et al. | 606/99 |
| D525,506 | S | | 7/2006 | Downing, Jr. | D8/78 |
| D562,101 | S | | 2/2008 | Martone | |
| D567,620 | S | | 4/2008 | Martone | |
| D572,106 | S | | 7/2008 | Chen | |
| 2004/0045411 | A1 | | 3/2004 | Youngren et al. | |
| 2004/0261188 | A1 | | 12/2004 | Mathis | |
| 2006/0075572 | A1 | | 4/2006 | Young | |
| 2007/0226913 | A1 | | 10/2007 | Woolley | |

FOREIGN PATENT DOCUMENTS

| | | | |
|---|---|---|---|
| DE | 199 37 951 | A1 | 3/2000 |
| DE | 20 2005 007 075 | U1 | 4/2006 |
| GB | 276509 | | 9/1926 |
| GB | 2 355 223 | A | 4/2001 |
| WO | WO 2007/038158 | | 4/2007 |
| WO | WO 2007038158 | A1 * | 4/2007 |

OTHER PUBLICATIONS

Printout of Stanley FUBAR demolition tool from Gizmodo.com Sep. 5, 2006.

European Search Report issued in related international application, Mar. 5, 2008, 6 pages.

Examination Report issued for EP Patent Application No. 08158710.7, dated Oct. 2, 2009.

European Search Report, dtd Nov. 3, 2008, in EP Application No. 08158710.7, 7 pp.

Examination Report issued for EP Patent Application No. 08158710.7, dated Mar. 10, 2010.

Answer to Plaintiff's Complaint, United States District Court for the District of Arizona, Case No. CV-01040-PHX-NVW, Document 12, Sep. 22, 2008, pp. 1-8 and Attachment A.

Examination Report issued for EP Patent Application No. 08158710.7, dated Dec. 2, 2010.

* cited by examiner

DEMOLITION UTILITY TOOL

CROSS REFERENCE TO RELATED APPLICATIONS

This application includes subject matter related to U.S. patent application Ser. No. 11/391,230, filed Mar. 29, 2006, which is hereby incorporated by reference herein in its entirety.

BACKGROUND OF THE INVENTION

1. Field of the Invention

The invention relates to a multi-functional demolition utility tool and methods for the manufacture thereof.

2. Description of Related Art

There are many hand tools that are traditionally used for demolition of construction or building materials. A "crow bar," for instance, typically has a straight pry bar end attached to a long lever arm and a hooked pry bar end at its opposite terminus. Some tools have pry bar ends that are forked for use in removing nails or other fasteners and otherwise wedging into building materials. Additional demolition tools include various sledge hammers, grasping equipment, and other tools.

However, some of these demolition tools present certain drawbacks or limited capabilities. For example, typical board grasping equipment is unsuitable for successfully demolishing lumber or grasping materials or boards of different thicknesses. In addition, certain tools with pry bar ends do not enable full range of motion due to other implements located at opposite ends of the tool bottoming out on a work surface. Furthermore, the configuration of these pry bar ends often interferes with the comfortable use of the implements located at the other ends of the tool.

Other demolition tools are made from material that is not intended to be struck by a striking tool to enable it to be used in a chisel-like manner. Some tools that are used for demolition, but designed for other purposes, are made from multiple parts as opposed to being integrally formed. This adds to the cost and complexity of the structure, and potentially reduces the strength thereof.

Additionally, certain demolition tool users such as, for example, fire and rescue professionals or other users, must carry a variety of specialty tools in addition to a demolition tool. A demolition tool with additional capabilities would be advantageous.

BRIEF SUMMARY OF THE INVENTION

The present disclosure relates to a demolition tool for demolishing construction material, building material, or other material and for providing other capabilities. In one embodiment, the demolition tool comprises a handle with a head at a first end of the handle, the head having a longitudinal central plane. In one embodiment, the head includes a strike contact face. The strike contact face includes a flat surface that can be struck by a hammer or other striking tool or that can be used to strike building or other material for demolition purposes or for other purposes. In one embodiment, the plane or surface of the strike contact face is parallel with the main axis of the handle and perpendicular to the longitudinal central plane of the head.

In one embodiment, the head also includes grasping jaws. In one embodiment, the grasping jaws may be utilized to grasp, manipulate, and/or otherwise demolish building materials such as, for example, lumber or other building materials.

The grasping jaws include one or more steps on one or both of an upper jaw or a lower jaw. The grasping jaws having one or more steps may form multiple gaps. The multiple gaps may accommodate materials or boards having different thicknesses. In some embodiments, the grasping jaws include one or more teeth on their interior grasping surfaces. In one embodiment, the opening formed by the grasping jaws is perpendicular to the main axis of the handle. In one embodiment, the grasping jaws extend generally along the longitudinal central plane of the head.

In some embodiments, the demolition tool includes a chisel blade on the opposite side of the head from the strike contact face. In one embodiment, the chisel blade is formed as part of the upper jaw of the grasping jaws. The chisel blade may be used to penetrate building materials such as wood (or other materials) for the purposes of demolition or for other purposes.

In one embodiment, the demolition tool includes a bent end pry bar at a second end of the handle. Bent end pry bar may enable the removal of fasteners such as, for example, nails, brads, staples, or other fasteners, or may enable general prying apart of materials. In one embodiment, the bent end pry bar is bent in a direction that is 90 degrees offset from the central longitudinal plane of the head. This offset enables the use of the bent end pry bar without interference from the head or any implements thereon (e.g., the grasping jaws, the strike contact surface, or other implements). Additionally, the 90 degree offset moves the bent end pry bar out of the plane of use of implements on the head.

In one embodiment, the demolition tool includes a blunt blade edge located on the head, below the strike contact face. The blunt blade edge may include a tapered wedge that may be utilized to break apart or otherwise demolish construction materials such as, for example, wood, softer metals, or other materials by striking blows upon the material.

The demolition tool, including the handle, the head, the bent end pry bar, and/or other portions of the demolition tool, may comprise a single integrally molded metal material, as opposed to multiple parts jointed or fastened together. In some embodiments, the demolition tool is manufactured to weigh between 3.5 to 4.5 lbs., and in some embodiments, approximately 4 lbs. This weight provides a tool with enough mass and inertia to aid in demolition of construction materials or other materials. In some embodiments, the demolition tool is manufactured to weigh between 8.0 and 8.25 lbs. In one embodiment, the demolition tool may be hardened to Rockwell C 38-44. Thus, the demolition tool is softer than conventional tools that can be used to strike it, but harder than the materials it is used to strike (e.g., wood, aluminum, or other materials).

In some embodiments, the demolition tool may include one or more additional features such as, for example, a fixed wrench element for manipulating nuts, bolts, or other fasteners and/or a spanner wrench element for manipulating water handling plumbing or other hardware. In some embodiments, the demolition tool may include a gas shut off valve wrench element incorporated into the forked arms of the bent end pry bar. In some embodiments, the demolition tool may include one or more recesses in the handle. Inserts may be secured to these recesses to provide various features such as, for example, improved grip, shock absorption, heat transfer resistance, electrical insulation, differential indication, and/or other features.

These and other objects, features, and advantages of the invention will be apparent through the detailed description of the preferred embodiments and the drawings attached hereto. It is also to be understood that both the foregoing summary and the following detailed description are exemplary and not restrictive of the scope of the invention.

DETAILED DESCRIPTION OF THE INVENTION

Figure 1:
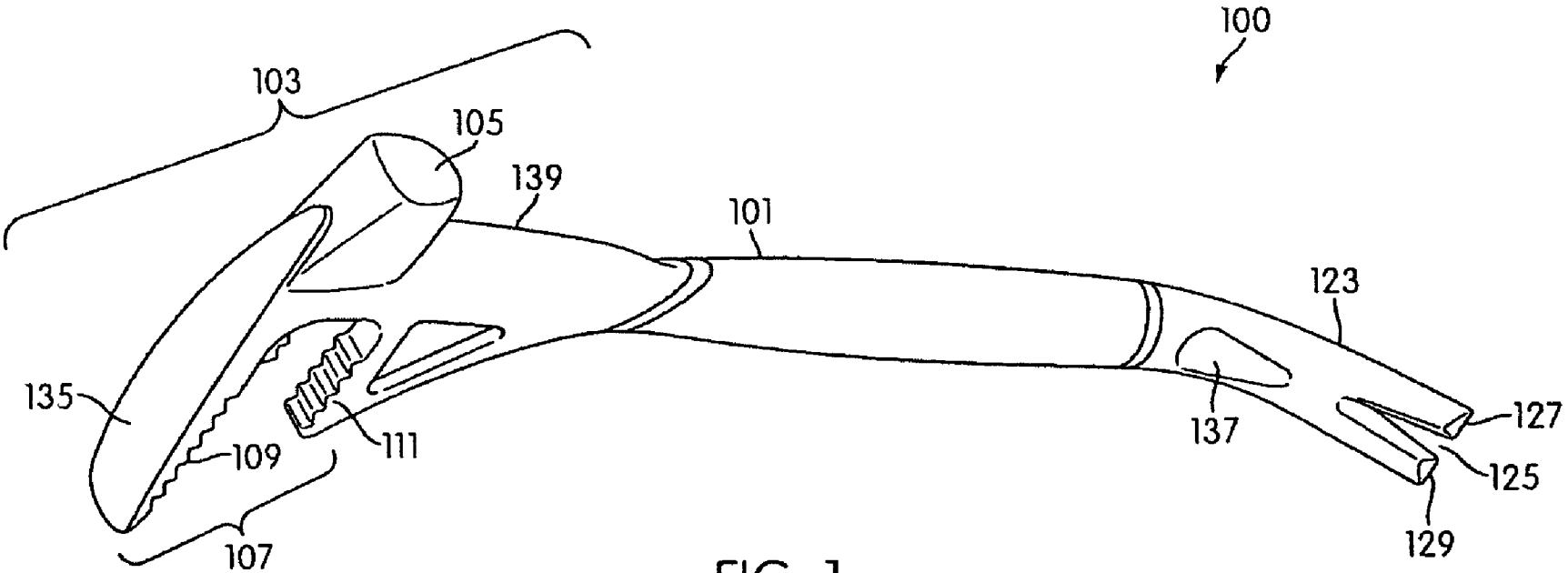
FIG. 1 illustrates a perspective view of a demolition tool according to an embodiment of the invention.
Figure 2:
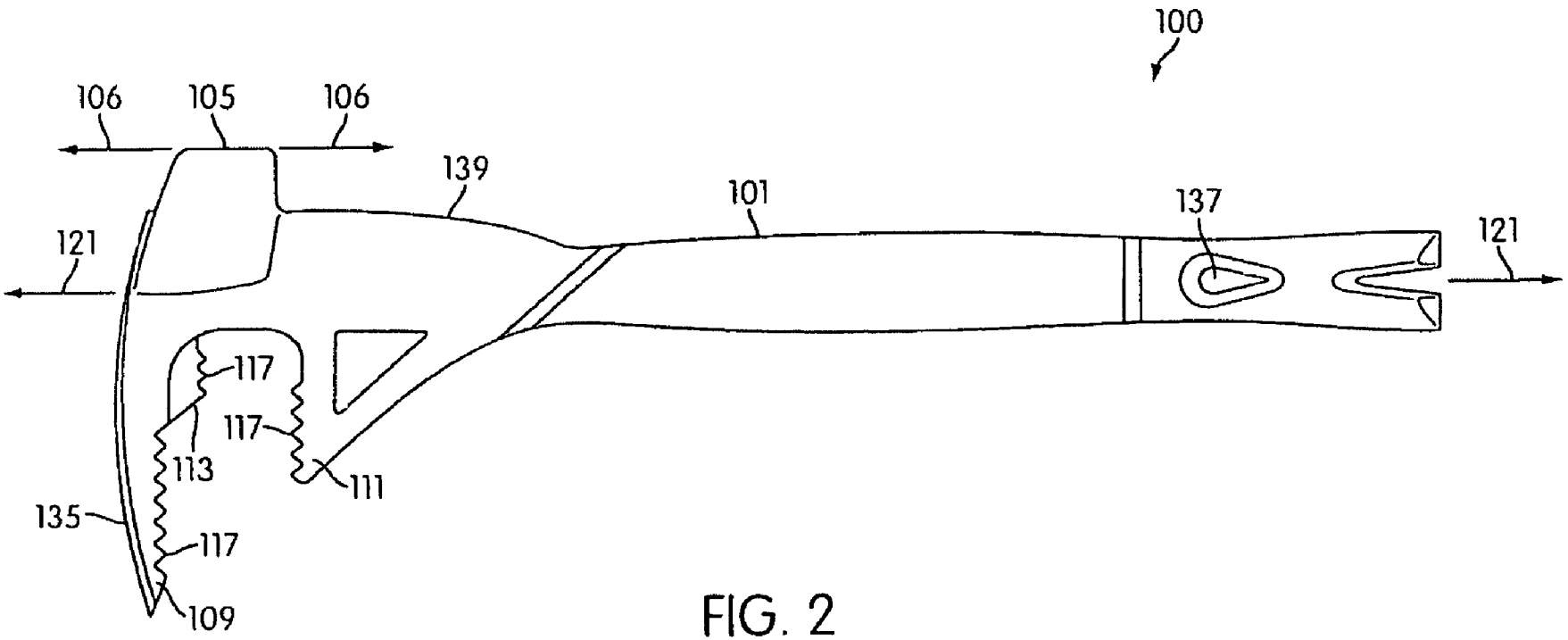
FIG. 2 illustrates a side view of a demolition tool according to an embodiment of the invention.

The invention provides a demolition utility tool for demolishing construction material, building material, or other material and for performing other functions. FIG. 1 illustrates a demolition tool 100 according to an embodiment. In one embodiment, demolition tool 100 comprises a handle 101 with a head 103 at a first end of handle 101. In some embodiments, handle 101 may be an elongate handle. In one embodiment, head 103 has a longitudinal central plane (plane 131 of FIGS. 4A and 4B) that bisects head 103. In one embodiment, head 103 includes a strike contact face 105. Strike contact face 105 includes a generally flat surface that can be struck by a hammer or other striking tool or that can be used to strike building or other material for demolition purposes or for other purposes. In one embodiment, the plane 106 or surface of strike contact face 105 is parallel with the main axis 121 of handle 101, as illustrated in FIG. 2.

Figure 3:
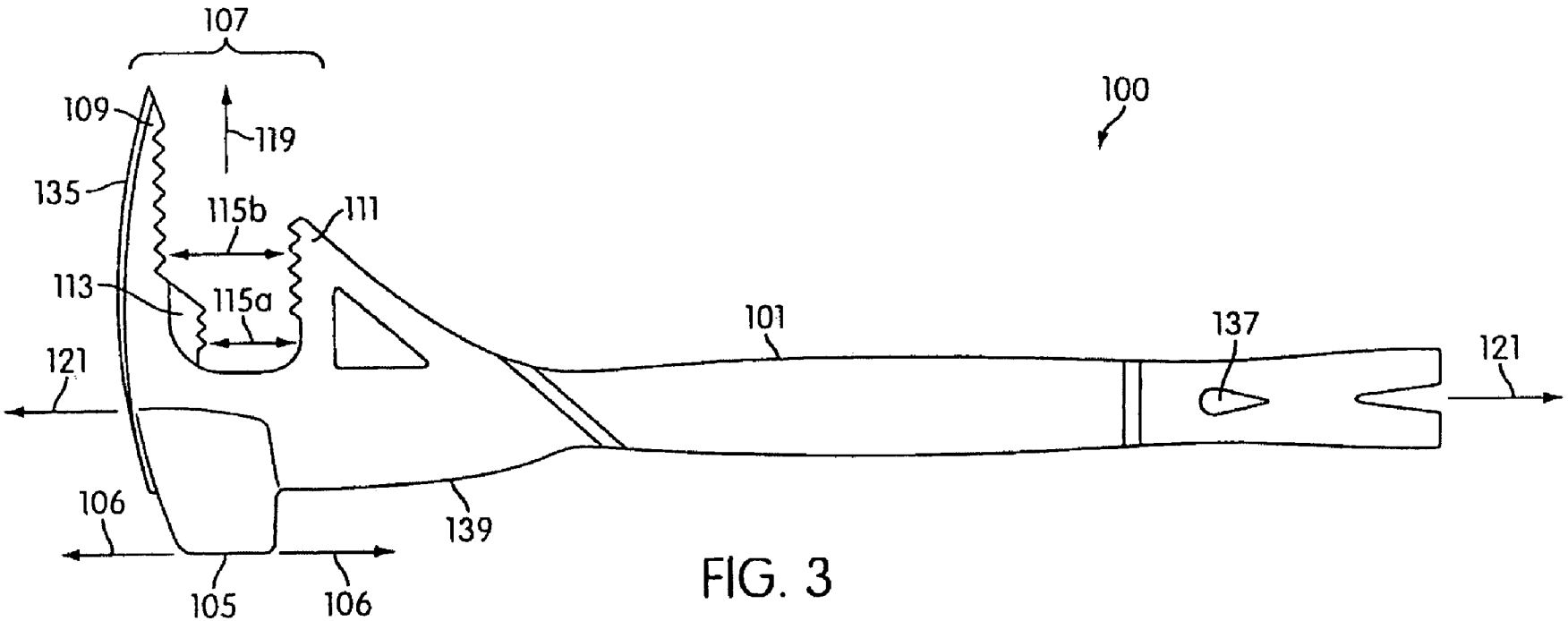
FIG. 3 illustrates a side view of a demolition tool according to an embodiment of the invention.

In one embodiment, head 103 includes grasping jaws 107. In one embodiment, grasping jaws 107 comprise an upper jaw 109 and a lower jaw 111. In some embodiments, grasping jaws 107 may be utilized to grasp, manipulate, and/or otherwise demolish building materials such as, for example, lumber or other building materials. Grasping jaws 107 include one or more steps on one or both of upper jaw 109 or lower jaw 111. FIG. 2 illustrates a side view of demolition tool 100 wherein upper jaw 109 includes a single step 113. As shown, step 113 has teeth 117. Grasping jaws 107 having one or more steps may form multiple gaps of different length within grasping jaws 107. For example, FIG. 3 illustrates a side view of demolition tool 100 according to an embodiment of the invention, wherein grasping jaws 107 include multiple gaps 115*a* and 115*b*. The multiple gaps within grasping jaws 107 may accommodate materials having different thicknesses. For instance, in one embodiment, gap 115*a* between step 113 and lower jaw 111 is approximately ¾ inches wide (or perhaps a bit narrower) so that it may accommodate lumber or other material that is ¾ inches thick, while gap 115*b* between upper jaw 109 and lower jaw 111, is approximately 1¼ inches wide (or perhaps a bit narrower) so that it may accommodate lumber or other material that is 1¼ inches thick. Other gaps having other sizes may exist.

In one embodiment, the surface on upper jaw 109 carrying or defining teeth 117 is generally parallel to the surface on lower jaw 109 carrying or defining teeth 117. Similarly, the teeth 117 on step 113 extend along a line that is generally parallel to the teeth 117 on lower jaw 111. Otherwise stated, the points of the teeth 117 on the lower jaw 111 are parallel to the points (or lines extending through the points) on the upper jaw 109 and step 113. In another embodiment, some of the steps included within grasping jaws 107 do not have teeth 117. In one embodiment, the opening formed by grasping jaws 107 is perpendicular to the main axis of handle 101. FIG. 3 illustrates opening 119, which is perpendicular to the main axis 121 of handle 101. In one embodiment, the opening formed by grasping jaws 107 extends generally along the longitudinal central plane (i.e., plane 131) of head 103.

Demolition tool 100 includes a chisel blade 135, on the opposite side of head 103 from strike contact face 105, as illustrated in FIGS. 1-4*b*. In one embodiment, chisel blade 135 is formed upon upper jaw 109 of grasping jaws 107. Chisel blade 135 may be used to penetrate building materials such as wood (or other materials) for the purposes of demolition or for other purposes. In one embodiment, chisel blade 135 may be positioned on a workpiece to be penetrated, and the strike contact face 105 may be struck by a hammer or other striking tool, such that chisel blade 135 is driven into the workpiece.

Figure 5:
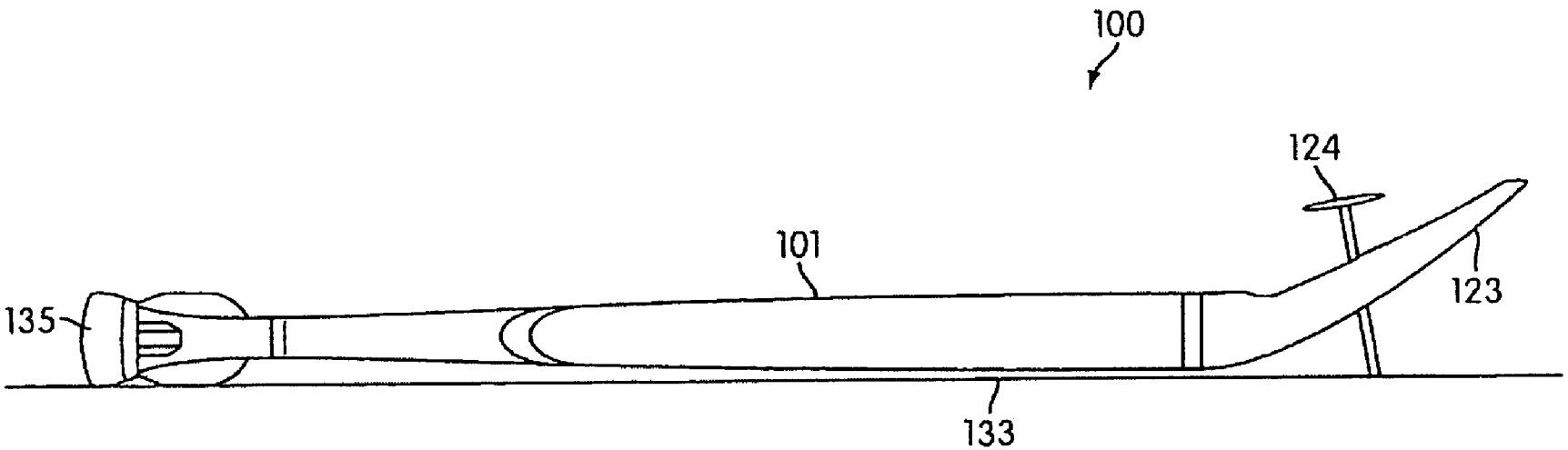
FIG. 5 illustrates a side view of a demolition tool according to an embodiment of the invention.

In one embodiment, demolition tool 100 includes a bent end pry bar 123 at a second end of handle 101. In some embodiments, bent end pry bar 123 includes a forked end having a V-shaped gap 125 in between tapered ends 127 and 129. The bent end pry bar 123 may enable the removal of fasteners such as, for example, nails, brads, staples, or other fasteners from a workpiece or may enable general prying apart of materials. FIG. 5 illustrates a side view of demolition tool 100 according to an embodiment of the invention, wherein pry bar 123 is being used to remove a fastener 124 from a work surface 133.

Figure 4A:
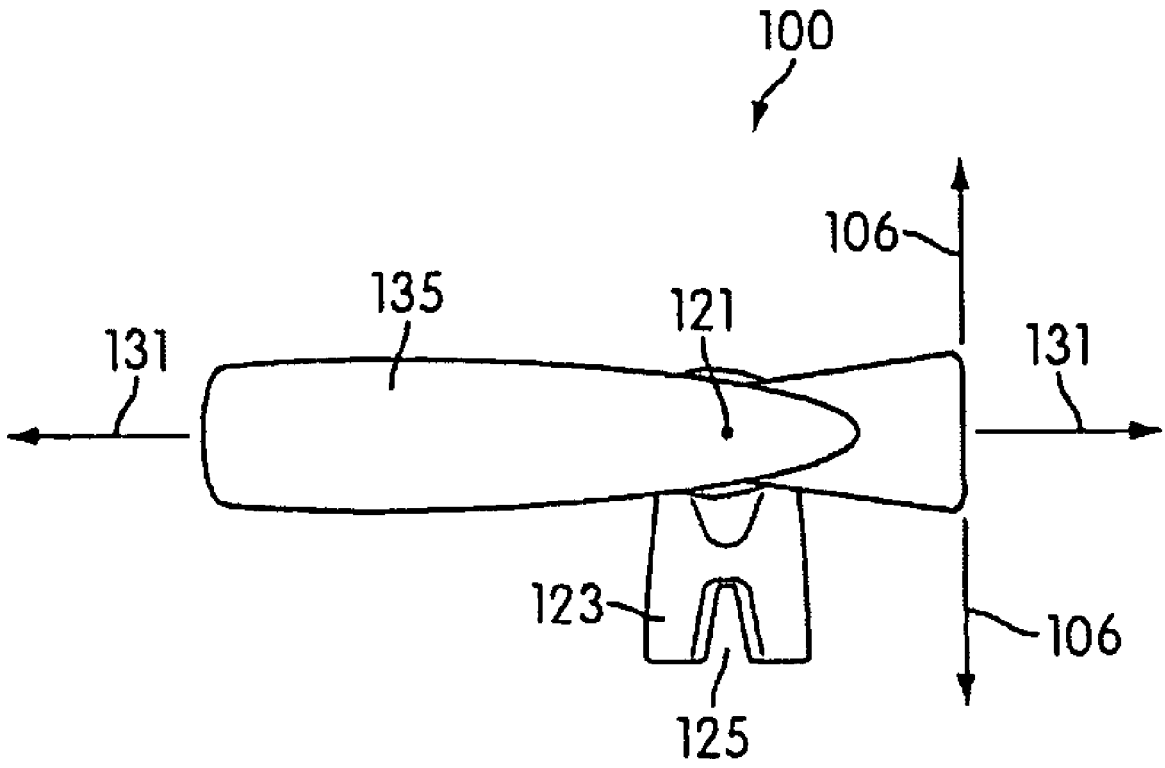
FIG. 4A illustrates an end view of a demolition tool according to an embodiment of the invention.
Figure 4B:
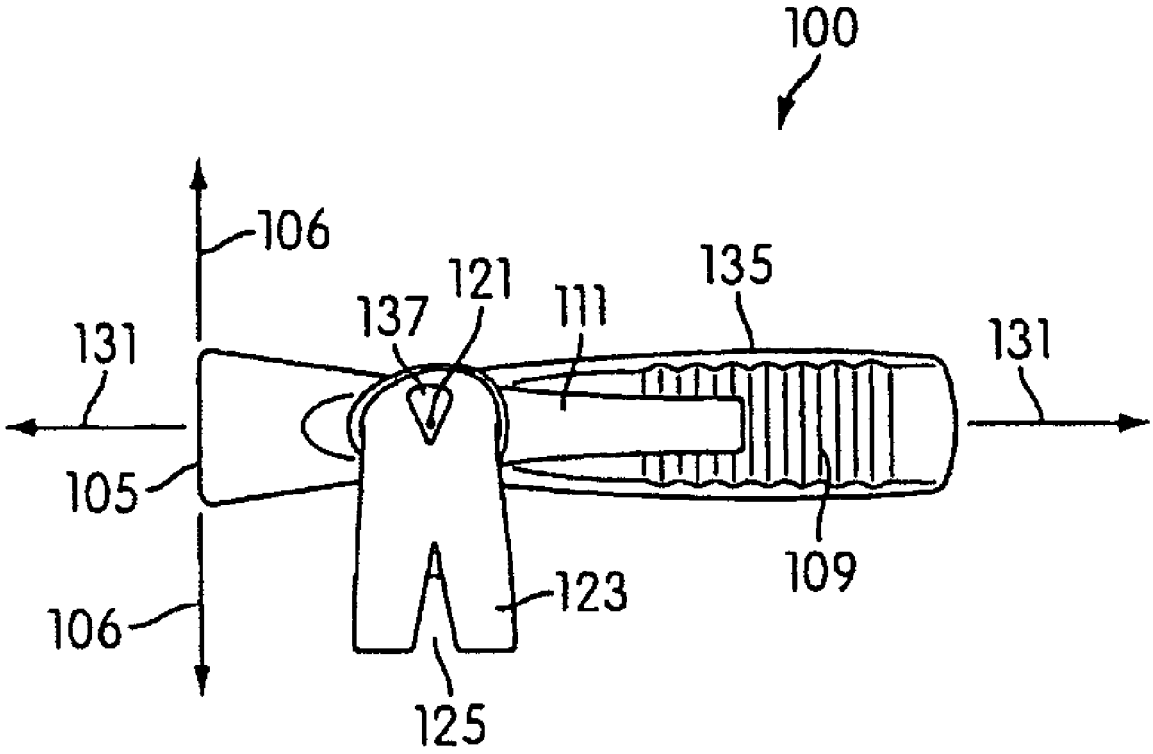
FIG. 4B illustrates an end view of a demolition tool according to an embodiment of the invention.

In one embodiment, bent end pry bar 123 is bent in a direction that is 90 degrees offset from plane 131 that bisects the head 103. FIGS. 4A and 4B illustrate end views of demolition tool 100 according to one embodiment, wherein bent end pry bar 123 is offset 90 degrees from plane 131 of head 103. This offset enables the use of bent end pry bar 123 without interference from head 103 or any implements thereon (e.g., grasping jaws 107, strike contact surface 105, or other implements). For example, bent end pry bar may be used to pry material or remove a fastener on a flat work surface (such as work surface 133 in FIG. 5) without head 103 causing demolition tool 101 to prematurely bottom out on work surface 133. A user may utilize the full range of motion bent end pry bar 123 to pry until head 103 bottoms out on work surface 133. Additionally, the 90 degree offset moves bent end pry bar 123 out of the plane of use of implements on head 103.

In one embodiment, demolition tool 100 includes an opening 137. Opening 137 may include a hole extending completely through the width of demolition tool 100. FIGS. 1-3 and 4B illustrate demolition tool 100 having opening 137 according to an embodiment. In some embodiments opening 137 is located on handle 101, on bent end pry bar 123, between bent end pry bar 123 and handle 101, or in another location on demolition tool 100. In some embodiments, opening 137 is a tear-dropped-shaped opening and enables the removal of nails, brads, or other fasteners from building materials or other materials. Opening 137 may be beveled on one or both sides (FIG. 2 illustrates a beveled side of opening 137).

Figure 6:
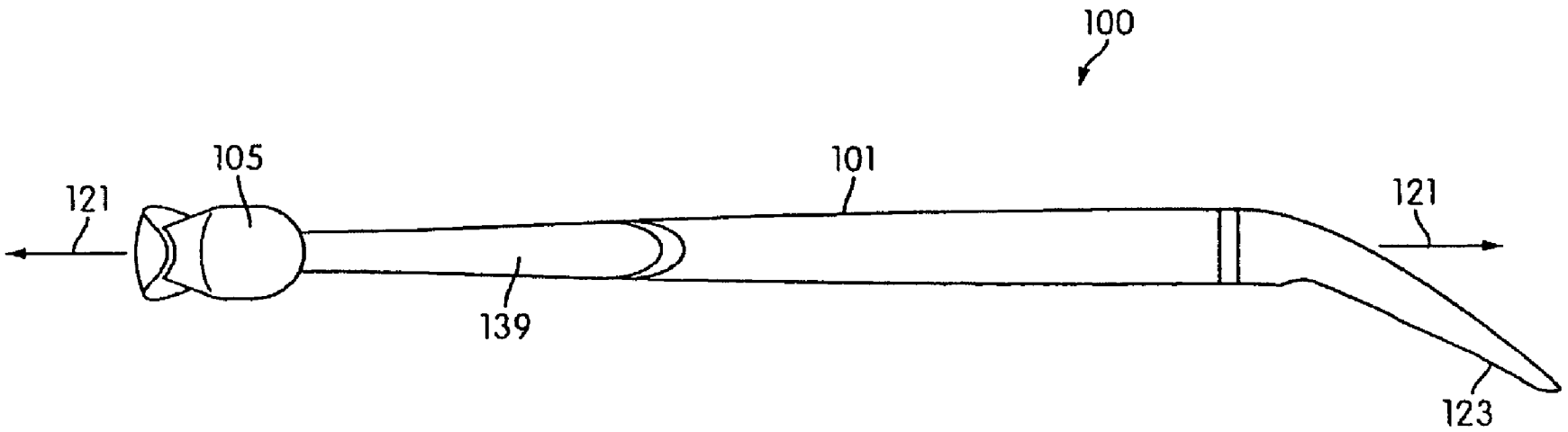
FIG. 6 illustrates a side view of a demolition tool according to an embodiment of the invention.
Figure 7A:
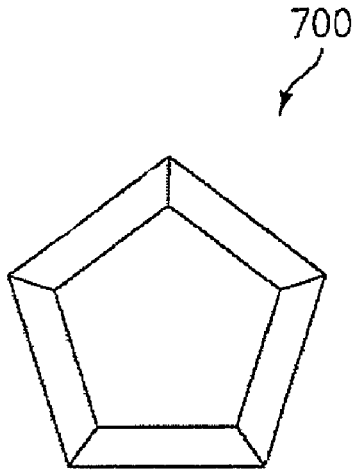
FIGS. 7A-7D illustrate an example of a tapered pentagonal nut.
Figure 7B:
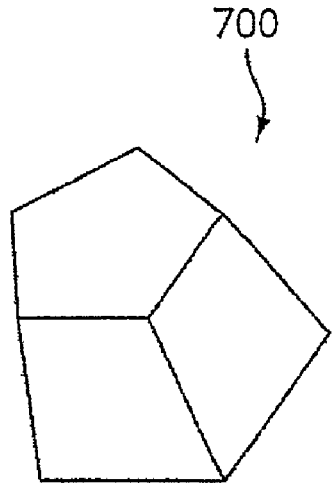
Figure 7C:
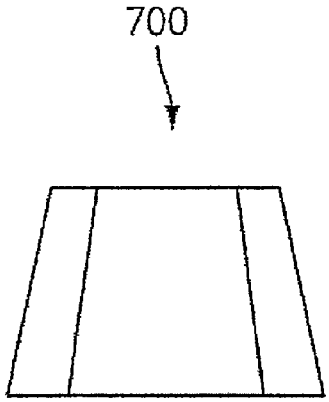
Figure 7D:
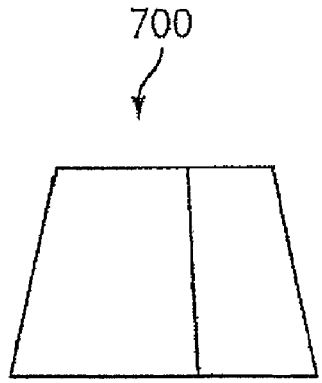
FIG. 7D PRIOR ART

In one embodiment, demolition tool 100 includes a blunt blade edge 139. FIGS. 1-3 illustrate an embodiment of demolition tool 100 wherein blunt blade edge 139 is located on head 103, below strike contact face 105. FIG. 6 illustrates a side view of demolition tool 100 according to an embodiment of the invention, wherein blunt blade edge 139 is parallel to the main axis 121 of handle 101. In one embodiment, blunt blade edge 139 may exist on the same plane as the longitudinal central plane (i.e., plane 131) of head 103. Blunt blade edge 139 may include a tapered wedge that may be utilized to break apart or otherwise demolish construction materials such as for example, wood, metals, or other materials by striking blows upon the material. In some embodiments, blunt blade edge 139 is blunt enough such that it does not cut material in the same fashion as a knife, axe, or other sharp bladed tool. In other embodiments, blunt blade edge 139 has a sharp edge such as, for example, an edge similar to an axe or hatchet blade.

In one embodiment, demolition tool 100, including handle 101, head 103, bent end pry bar 123, and/or other portions of demolition tool 100, comprise a single integrally forged or molded metal material, as opposed to being formed from multiple parts jointed or fastened together.

In one embodiment, demolition tool 100 includes a grip material such as, for example, rubber, plastic, or other material on handle 101 or other portions of demolition tool 101. The gripping material may be placed over or secured to demolition tool 100 to aid in its use as a hand tool by providing a slip resistant and comfortable grip for a user's hands. In some embodiments, demolition tool 100 is manufactured to weigh approximately 3.5-4.5 lbs. and may weigh approximately 4 lbs. In some embodiments, demolition tool 100 or other demolition tool of the invention may be manufactured to weigh between 8.0 and 8.25 lbs.

As mentioned above, demolition tool 100 may be utilized in the demolition of construction or building materials. For example, demolition tool 100 may be utilized to break apart or otherwise demolish a workpiece when chisel blade 135 is placed on the workpiece and strike contact face 105 is struck by a hammer or other tool, thus, driving chisel blade 135 into the workpiece. Typically, striking tools, such as hammer heads are hardened to minimum hardness of Rockwell C 45 As such, tools or fasteners that are meant to be struck are hardened to a maximum hardness that is less than Rockwell C 45. As stated above, strike contact face 105 of the demolition tool may be struck by a hammer or striking tool to enable demolition tool 100 to be used as a chisel. As such, in one embodiment, strike contact face 105 or the entirety of demolition tool 100 may be hardened to Rockwell C 38-44. Thus, demolition tool 100 will be softer than tools used to strike it, but harder than the materials it will be used to demolish (e.g., wood, aluminum, or other materials).

To achieve a hardness of Rockwell C 38-44, certain manufacturing techniques are used. In one embodiment, demolition tool 100 is integrally formed (e.g., forged or molded) of steel and a two step heat treating process is utilized. First, demolition tool is hardened by heating the steel to between 810° C. to 870° C., and in one embodiment, between 830° C. to 850° C., and in one embodiment, approximately 840° C. At 840° C., the heat treatment temperature is maintained between 60-80 minutes, and in one embodiment, 70 minutes. After heat treatment, the tool is quenched in oil to rapidly cool the tool. At this point the steel is both hard and brittle. The second step of the process is to temper the steel, which reduces the hardness but adds toughness to the steel. Tempering is performed by heating the steel a second time to between 380° C. and 420° C., and in one embodiment, between 390° C. and 410° C., and in one embodiment, 400° C. The steel is then soaked at that temperature for between 140 and 160 minutes, and in one embodiment, 150 minutes.

As mentioned above, in some embodiments, demolition tool 100 may include one or more additional features such as, for example, a wrench element, a spanner wrench element, a hook element, a gas valve wrench element, and/or other features.

Fire hydrants in North America and other localities often utilize a tapered pentagonal nut to open and close their valves. FIGS. 7A through 7D illustrate an example of a tapered pentagonal nut 700 that may be used for such a purpose. In some instances, tapered nuts or other fasteners may include a taper of, for example, 1/16 of an inch over a fastener height of one inch. In some instances, nuts or other fasteners may include configurations other than pentagonal (e.g., square or other configuration).

Figure 8:
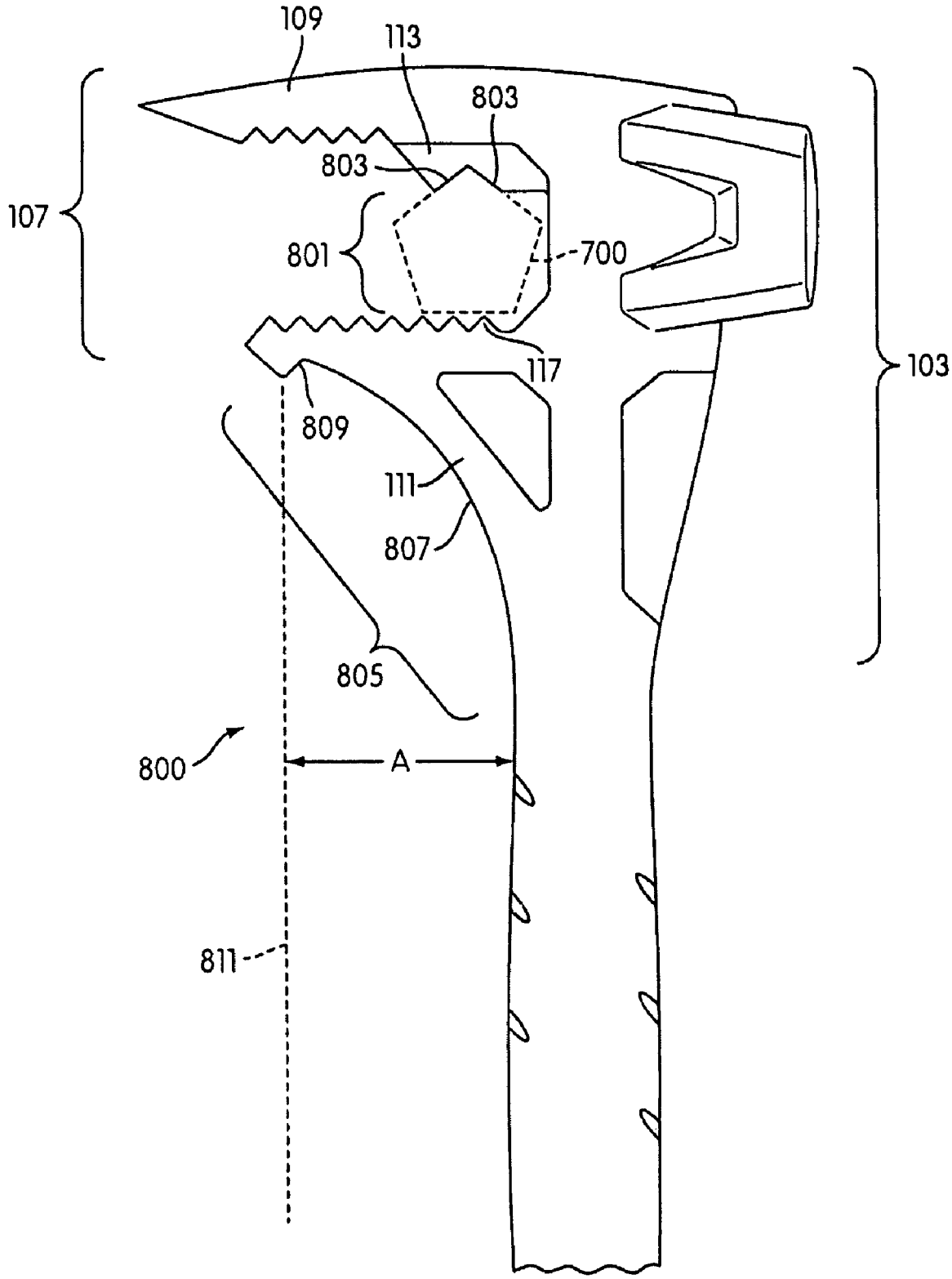
FIG. 8 illustrates a side view of a portion of a demolition tool according to an embodiment of the invention.

In some embodiments, the demolition tool may include a wrench element that enables opening/closing or other manipulation of nuts or other fasteners such as, for example, tapered pentagonal nut 700. FIG. 8 illustrates a portion of a demolition tool 800 with a fixed wrench element 801 integrated into grasping jaws 107. In some embodiments, wrench element 801 may include surfaces 803 (or surface portions 803) integrated into step 113 of upper jaw 109 or elsewhere in demolition tool 100. Surfaces 803 may be sized and shaped to conform to surfaces of a standard fastener or nut. Thus, for example, in one embodiment, step 113 of upper jaw 109 can interact with the surfaces of a pentagonal nut (e.g., nut 700), with the apexes teeth 117 of lower jaw 111 also interacting with a surface of the pentagonal nut (see dashed outline of nut 700 in FIG. 8), such that the nut may be loosened or tightened as needed) while still providing the functions necessary for grasping jaws 107 to operate accordingly. Wrench element 801 illustrated in FIG. 8 includes three wrench surfaces comprising the two surfaces 803 and the surface formed by the teeth 117 of lower jaw 111 that oppose step 113. As described above, these three surfaces engage three surfaces of a fastener (see e.g., dashed outline of nut 700 in FIG. 8), which enables loosening or tightening of the fastener. It should also be appreciated that four surfaces can also engage the nut 700 in FIG. 8.

In one embodiment, the wrench engaging surfaces may have a sloped or tapered configuration that corresponds to the slope or taper of a pentagonal nut that is to be engaged. In some embodiments, wrench element 801 may be used to manipulate pentagonal nuts or other pentagonal fasteners such as, for example, those on fire hydrants. In some embodiments, the surfaces of a wrench element of a demolition tool according to various embodiments of the invention may arranged such that it may loosen, tighten, or otherwise manipulate nuts or other fasteners having standard configurations other than pentagonal configurations (e.g., hexagonal, square, star-shaped, or other configuration). In some of such other embodiments, the wrench element 801 can have two or more (at least two) surfaces that correspond or mate with surfaces of the fastener.

In some embodiments, nuts or other fasteners may include configurations other than pentagonal (e.g., square or other configuration). Accordingly, wrench elements of demolition tools of the invention may be utilized to manipulate nuts or fasteners having configurations other than pentagonal (e.g., square or other configuration). Accordingly, the surfaces of a wrench element of a demolition tool of the invention may be specifically configured to manipulate fasteners having configurations other than pentagonal. In some embodiments, a wrench element of a demolition tool of the invention may be able to manipulate fasteners of multiple configurations (e.g., pentagonal and square).

In some embodiments, the demolition tool may include a spanner wrench element that enables manipulation of certain water handling plumbing mechanisms such as, for example, fire hydrants with valves, internal building pressurized fire hose lines and hose couplings, and/or other hardware. In some instances, fire hoses or other hoses may be closed by hose clamps. In some instances these hose clamps may be about 5 inches in diameter, and hoses may have an inside diameter of 1 to 6 inches. However, other sizes may be used with a spanner wrench element of a demolition tool as contemplated herein. Demolition tool 800 of FIG. 8 illustrates an example of a spanner wrench portion 805 that is incorporated into head 103 below grasping jaws 107. Spanner wrench portion 805 may be used to loosen and/or tighten hose clamps such as, for example, those used with fire hoses or may be used to manipulate other hose hardware. In some embodiments, spanner wrench portion 805 may be used to loosen and/or tighten hose clamps up to 5 inches in diameter. In some embodiments, a spanner wrench portion of the demolition tool may be used to loosen and/or tighten hose clamps of other dimensions.

Figure 9:
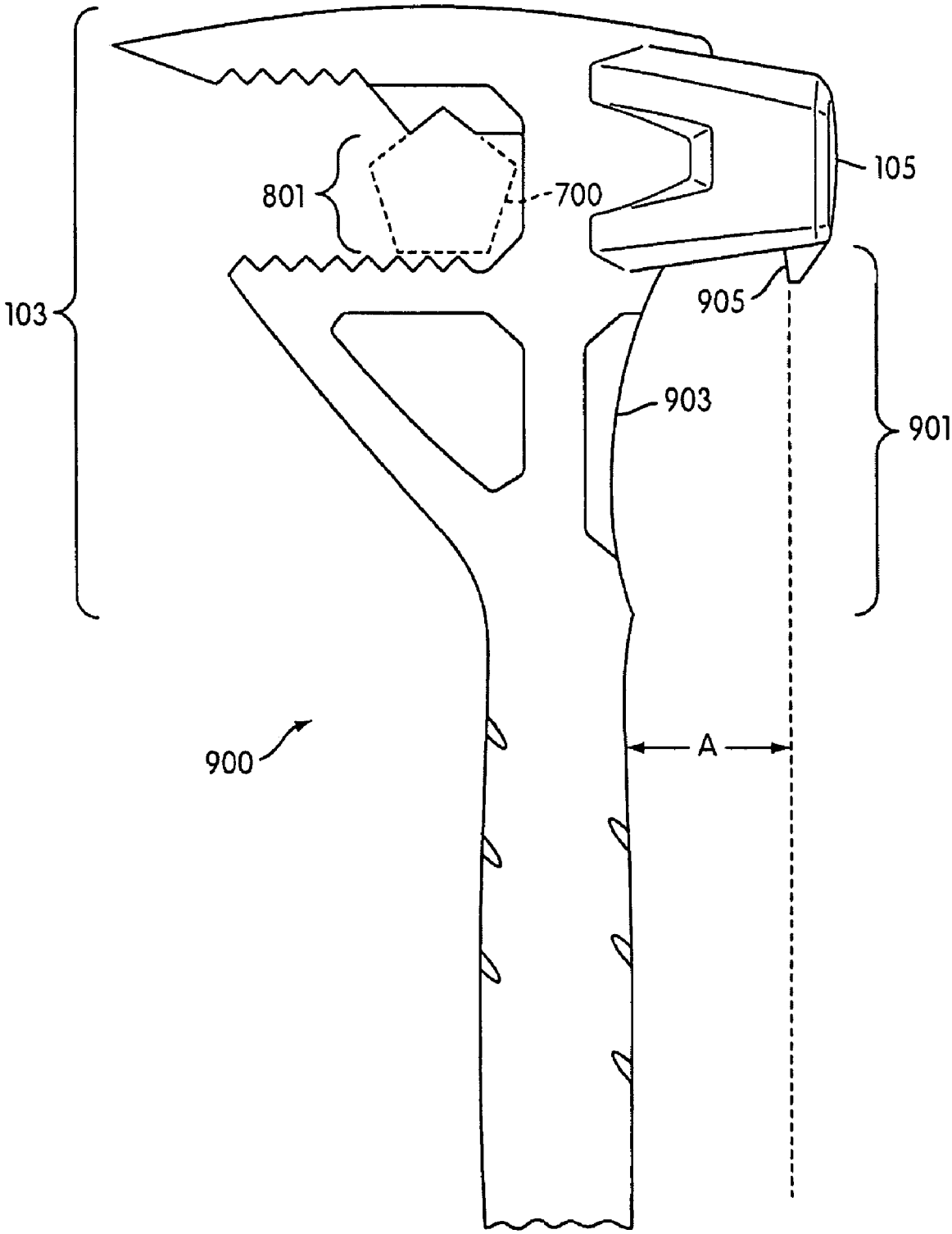
FIG. 9 illustrates a side view of a portion of a demolition tool according to an embodiment of the invention.

In some embodiments, spanner wrench 805 may include a curved surface 807 and a protrusion 809. In some embodiments, curved surface 807 may correspond to a curved surface of the hose clamp or other hose hardware, enabling protrusion 809 to engage with a protrusion on the hose clamp or other hose hardware. In some embodiments, the radius of curved surface 807 may be about 2.25 inches. In some embodiments, other radius' of curvature may be used. In some embodiments, the radius of curved surface 807 or other curved surfaces of a spanner wrench element of a demolition tool of the invention may be selected to provide strength to the spanner wrench element. In some embodiments, the spanner wrench element may function without a curved surface (e.g., a square configuration or other configuration may be used). In some embodiments, the range of sizes of hose clamp or other hardware that can be manipulated using a spanner wrench element of the demolition tool may be a function of a distance between the handle of a demolition tool (e.g., handle 101) and a line passing through the protrusion (e.g., protrusion 809, 905, or other protrusion) or "claw tip" of the spanner wrench that is drawn parallel to the handle (e.g., line 811 of FIG. 8; line 907 of FIG. 9). For example, distance "A" in FIGS. 8 and 9 illustrates a distance between lines 811/907 and handle 101. In some embodiments, distance A may be 1.7 inches, which may then enable a spanner wrench element to be utilized to manipulate hose hardware of 2.5 inches in diameter. However, a spanner wrench element having a distance A of 1.7 inches may also be used to manipulate hose hardware having lesser or greater diameters. In some embodiments, other distances between handle 101 and lines 811/907 may be used, which may enable use with hose hardware of different sizes.

Curved surface 807 may enable sufficient leverage and freedom of movement so as to enable a protrusion 809 engaged with the protrusion of the hose clamp or other hardware to act to tighten or loosen the hose clamp or other hardware as needed. In some embodiments, protrusion 809 of spanner wrench portion 805 may be used as a hook for pulling or otherwise manipulating building materials during demolition or during other activities.

In some embodiments, the fixed wrench element 801 and/or the spanner wrench portion 805 of a demolition tool according to the invention may be integrated into different parts of the demolition tool. FIG. 9 illustrates an example of a portion of a demolition tool 900, wherein a spanner wrench portion 901 having a curved surface 903 and a protrusion 905 is integrated into head 103 of the demolition tool below strike contact face 105. As described above with regard to spanner wrench portion 805, spanner wrench 901 may be used to loosen and/or tighten hose clamps or other hardware. Additionally, protrusion 905 of spanner wrench may be used as a hook for pulling or otherwise manipulating building materials during demolition or during other activities. FIG. 9 also illustrates a wrench element 801 which may be included in demolition tool 900.

Figure 10:
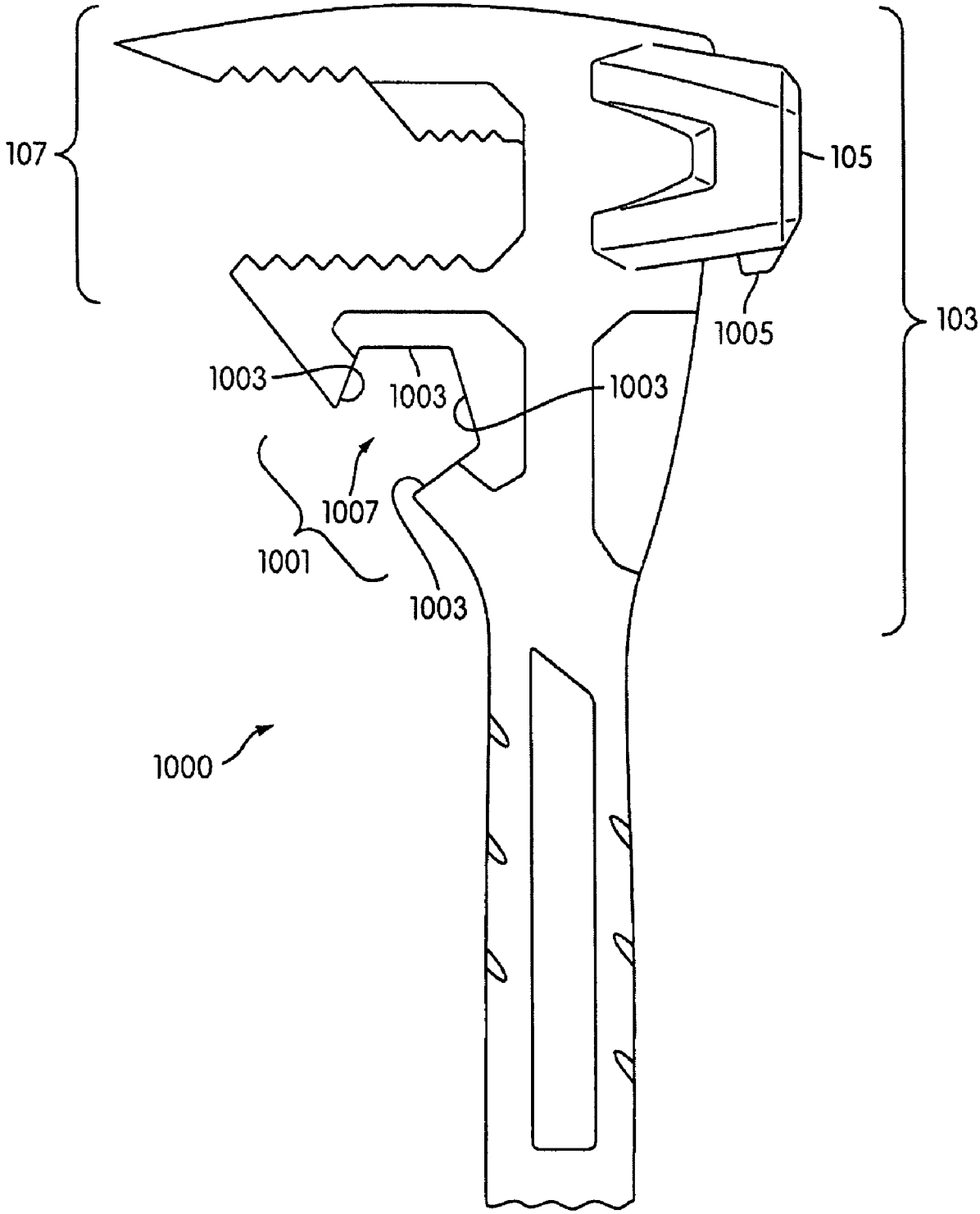
FIG. 10 illustrates a side view of a portion of a demolition tool according to an embodiment of the invention.

FIG. 10 illustrates an example of a portion of a demolition tool 1000, wherein a fixed wrench element 1001 having surfaces 1003 is integrated into head 103 of the demolition tool below grasping jaws 107. Similar to surfaces 803 and teeth 117 of demolition tool 800 described above, surfaces 1003 may interact with surfaces of a pentagonal nut (e.g., tapered pentagonal nut 700) or other fastener having a pentagonal structure to tighten and/or loosen the nut or fastener. Three or four of such surfaces 1003 may be provided. In some instances, an opening 1007 provided by wrench 1001 may be used to hook onto and pull or otherwise manipulate materials during demolition or during other activities. Demolition tool 1000 also includes a protrusion 1005 below strike contact face 105, which may be used as a hook for pulling or otherwise manipulating building materials during demolition or during other activities.

Figure 11:
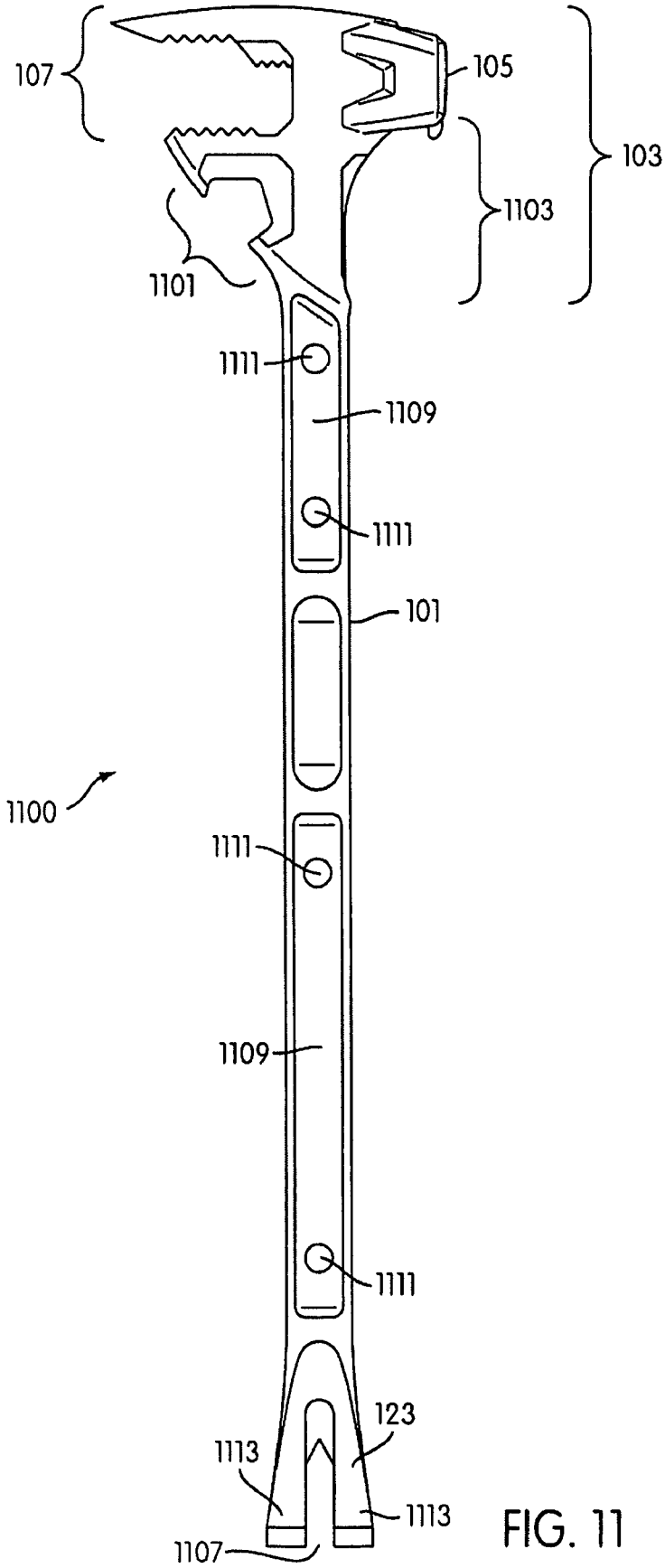
FIG. 11 illustrates a side view of a demolition tool according to an embodiment of the invention.

FIG. 11 illustrates demolition tool 1100, which includes a wrench element 1101 integrated into head 103 below grasping jaws 107 and a spanner wrench 1103 integrated into head 103 below strike contact face 105. Wrench element 1101 is shaped and configured to engage a pentagonal tapered nut, as discussed above.

Figure 12A:
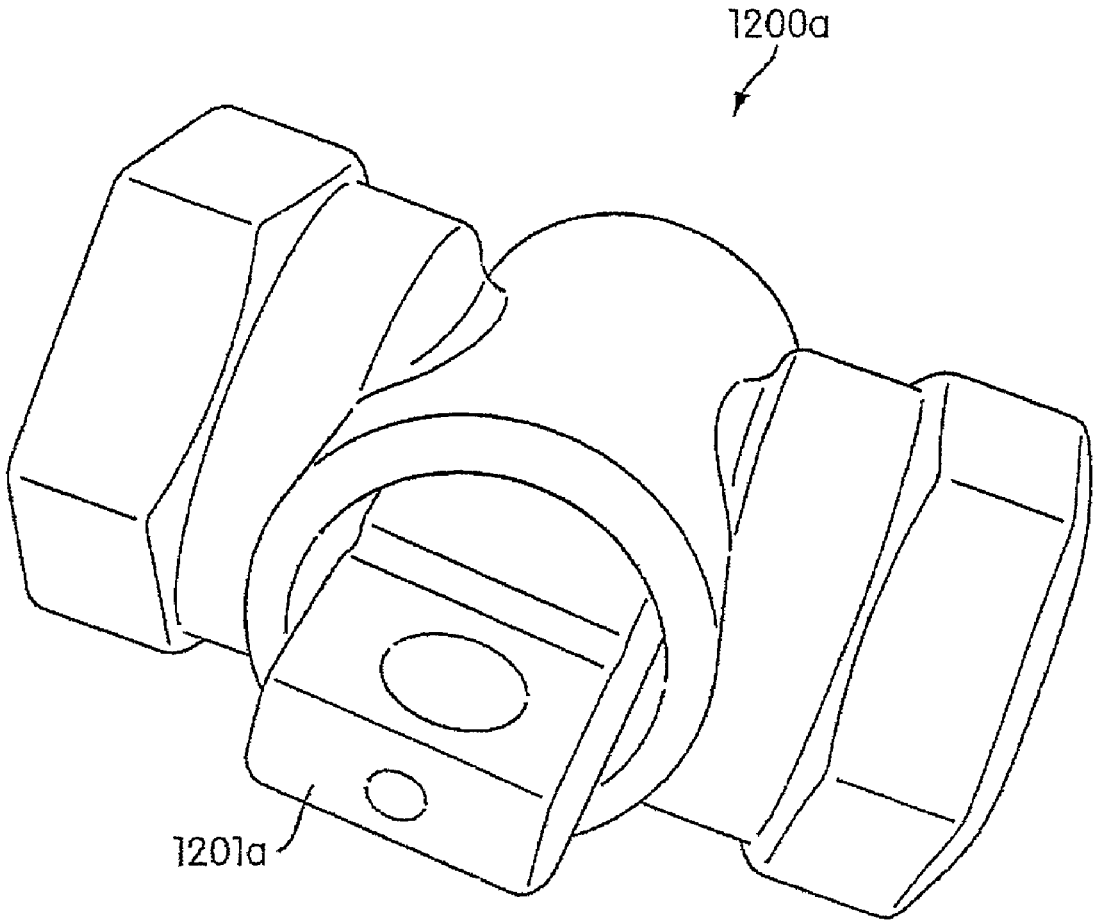
FIG. 12A PRIOR ART
FIGS. 12A-C illustrate examples of gas shut-off valves.
Figure 12B:
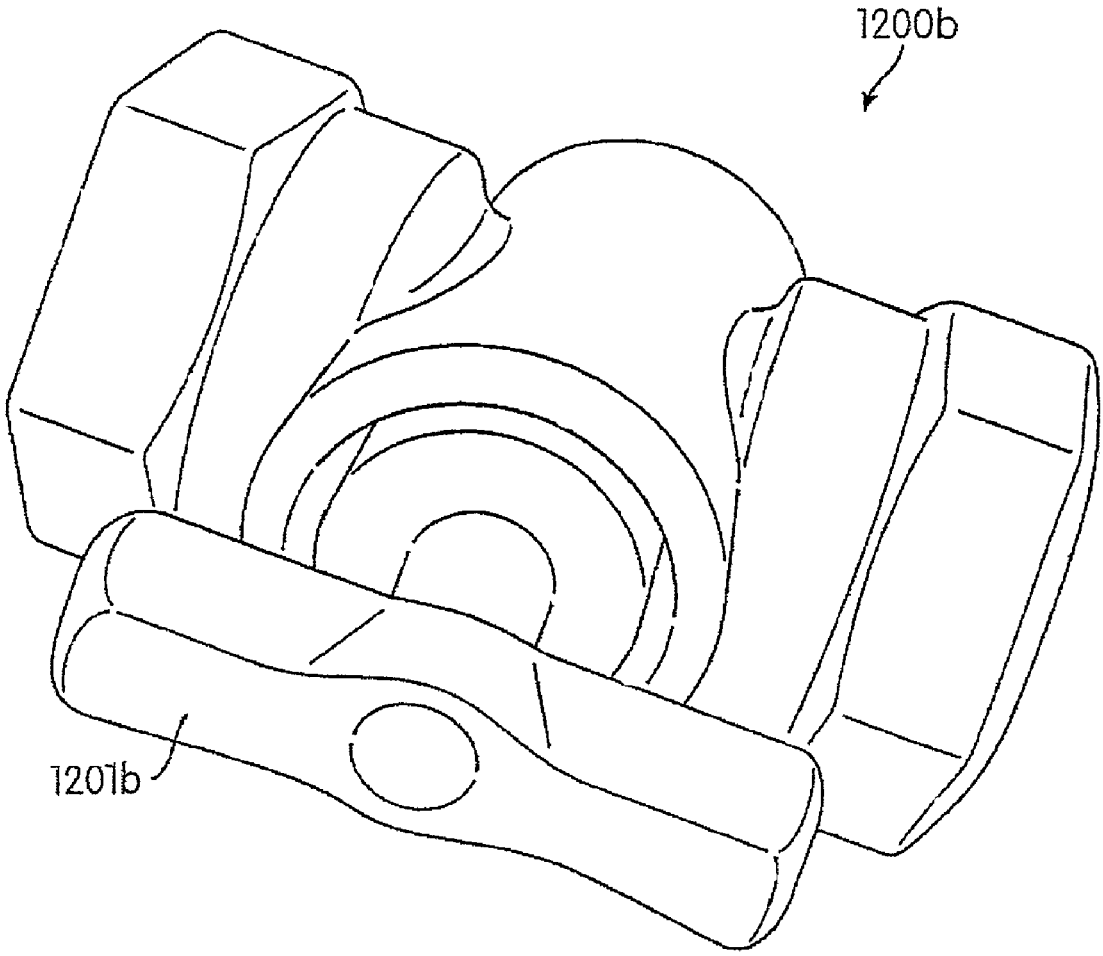
FIG. 12B PRIOR ART
Figure 12C:
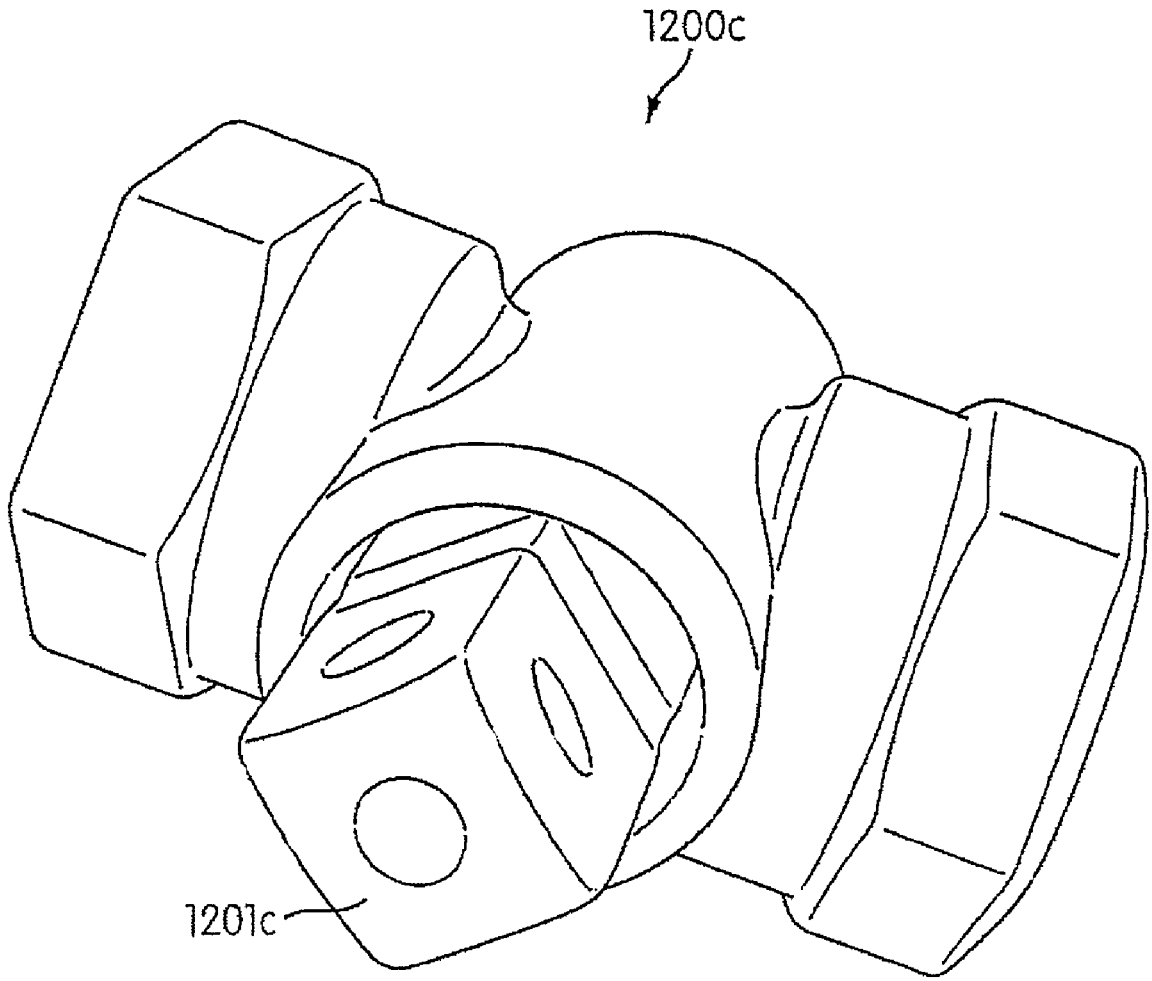
FIG. 12C PRIOR ART

In some embodiments, a demolition tool according to the invention may include a gas valve wrench element for manipulating (e.g., opening or closing) natural gas valves or other valves. In some instances, residential or other gas shut-off valves may include shut-off elements that range from ¼ inch to ½ inch thick. Other sizes may exist. FIGS. 12A-12C illustrate examples of gas shut-off valves 1200*a*, 1200*b*, and 1200*c*, having shut off elements 1201*a*, 1201*b*, and 1201*c*, that may be opened and/or closed using a gas valve wrench. As such, gas valve wrenches may include openings that accommodate such shut-off elements so that the corresponding valve may be opened or closed.

Figure 13:
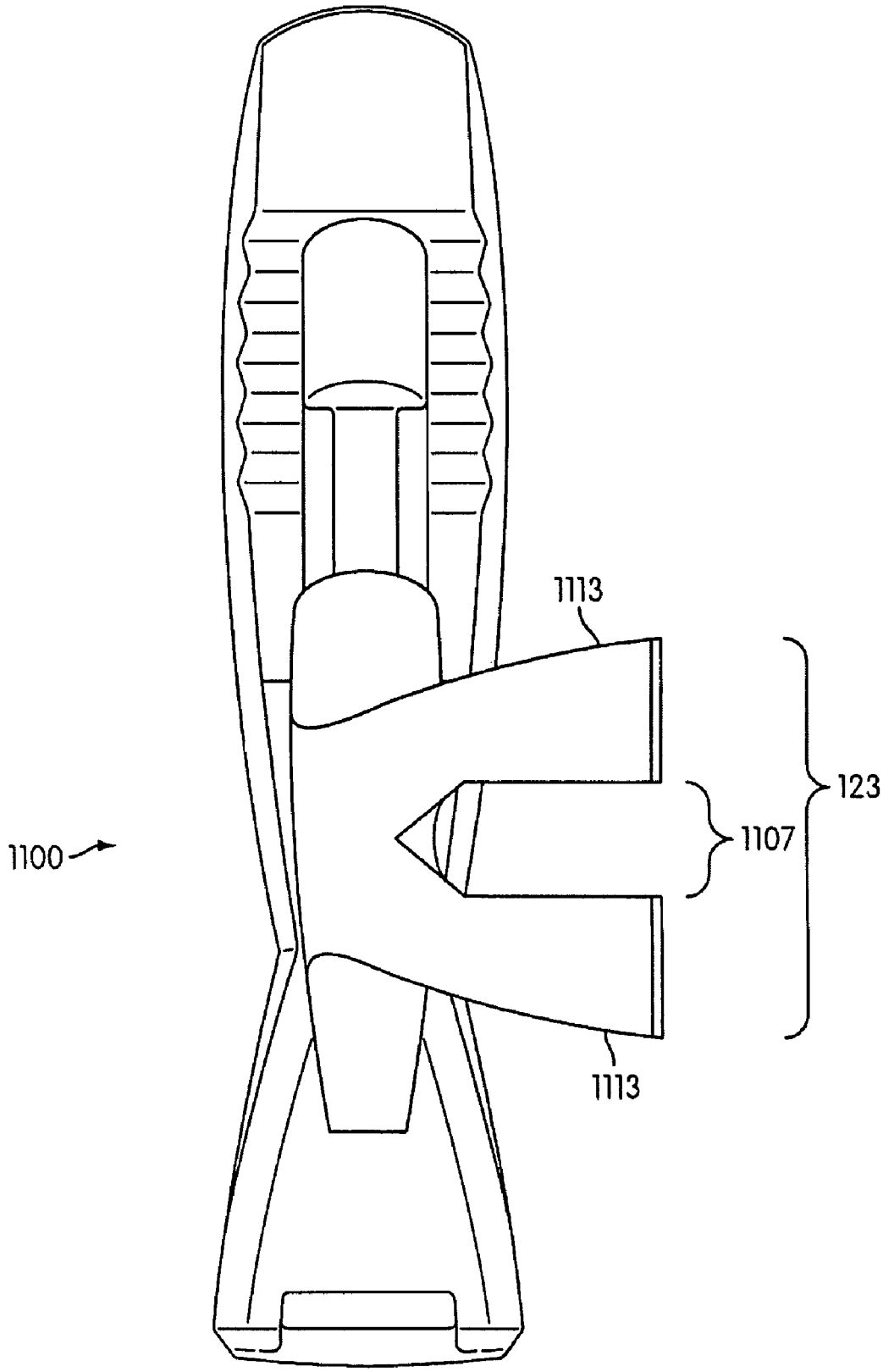
FIG. 13 illustrates an end view of a demolition tool according to an embodiment of the invention.

In some embodiments, a gas valve wrench element may be incorporated into the bent end pry bar of a demolition tool of the invention. FIG. 11 illustrates that demolition tool 1100 may include a bent end pry bar 123 including two arms 1113 that define a slot 1107 that accommodates shut off-elements of gas shut-off valves such that demolition tool 1100 may be used to open and/or close gas shut-off valves. Slot 1107 may be considered an extension of a v-shaped gap (e.g., v-shaped gap 125) of a bent end pry bar of a demolition tool according to the invention. FIG. 13 illustrates an end view of demolition tool 1100, including arms 1113 and slot 1107 of bent end pry bar 123. In some embodiments slot 1107 may be ½ inch wide (or slightly larger) so as to accommodate shut off elements up to ½ inch thick. In some embodiments, slot 1107 may have other widths so as to accommodate shut-off elements of other thicknesses. The inside walls of slot 1107 may be parallel from the tip of the opening of the slot back to the "V"-shaped nail-pulling portion. The parallel walls engage the shut-off elements (e.g., shut-off elements 1201*a*, 1201*b*, 1201*c*) of gas shut-off valves or other valves.

Figure 14:
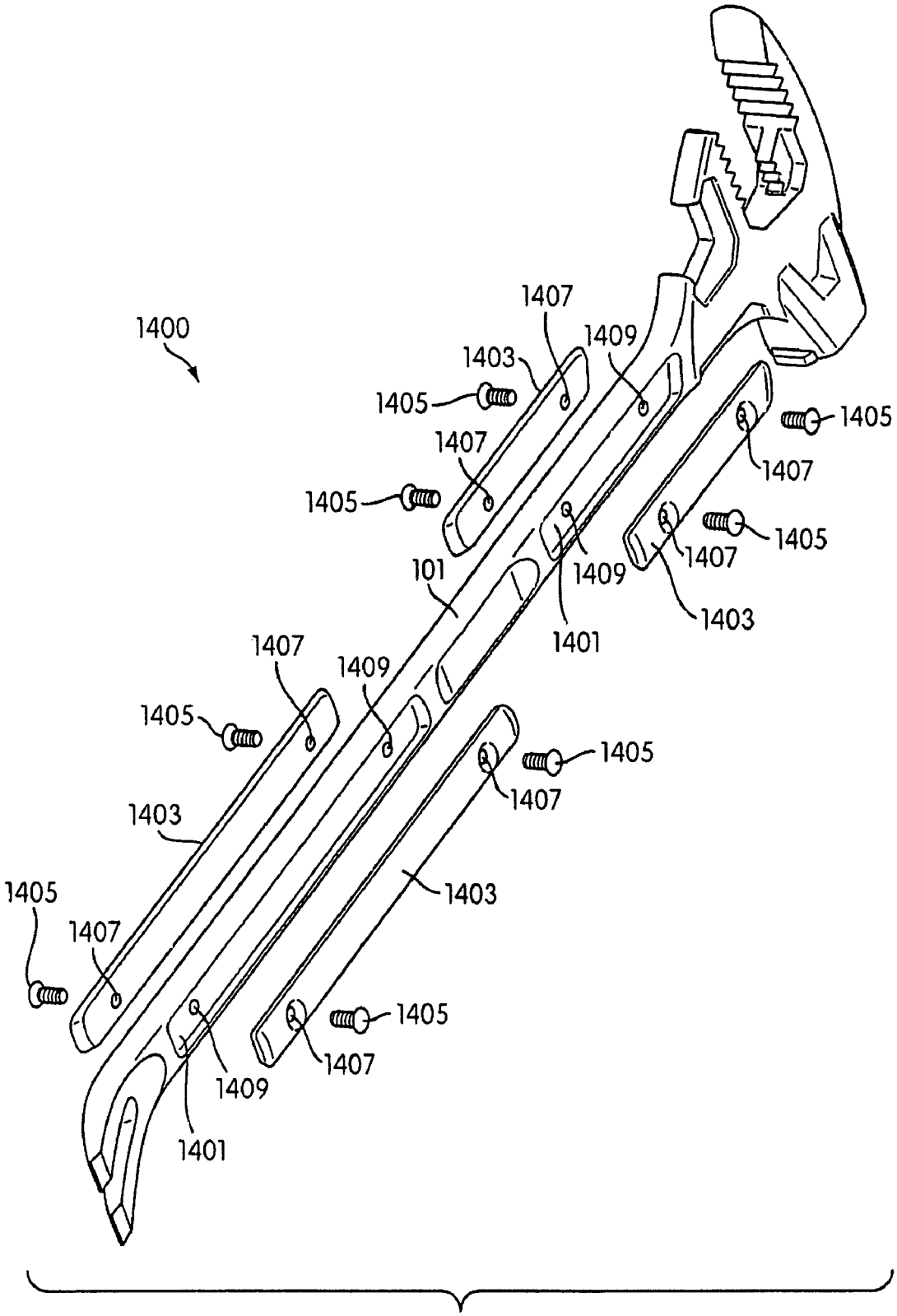
FIG. 14 illustrates a perspective view of a demolition tool according to an embodiment of the invention.

In some embodiments, a demolition tool according to the invention may include a handle that has recessed portions. In some embodiments, these recessed portions may reduce the amount of metal used to make the demolition tool and thus may save manufacturing costs and/or tool weight without compromising the structural integrity of the tool. FIG. 14 illustrates a demolition tool 1400 which includes recesses 1401 on handle 101 the demolition tool. FIG. 14 illustrates two recesses 1401 on handle 101, however two additional recesses 1401 may exist on the opposite side of handle 101. In some embodiments the sides of handle 101 may include different numbers of recesses (e.g., one long recess per side, multiple small recesses per side). In some embodiments, each side of handle 101 may have differing numbers of recesses (i.e., the number of recesses on either side of handle 101 need not be symmetrical).

Figure 15:
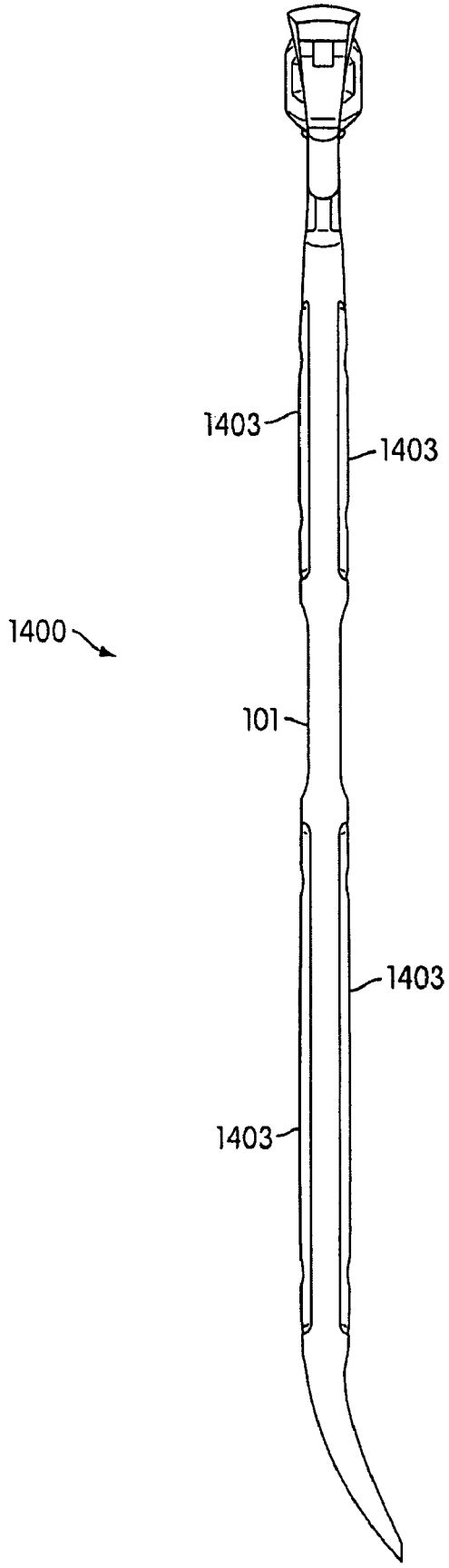
FIG. 15 illustrates a side view of a demolition tool according to an embodiment of the invention.
Figure 16:
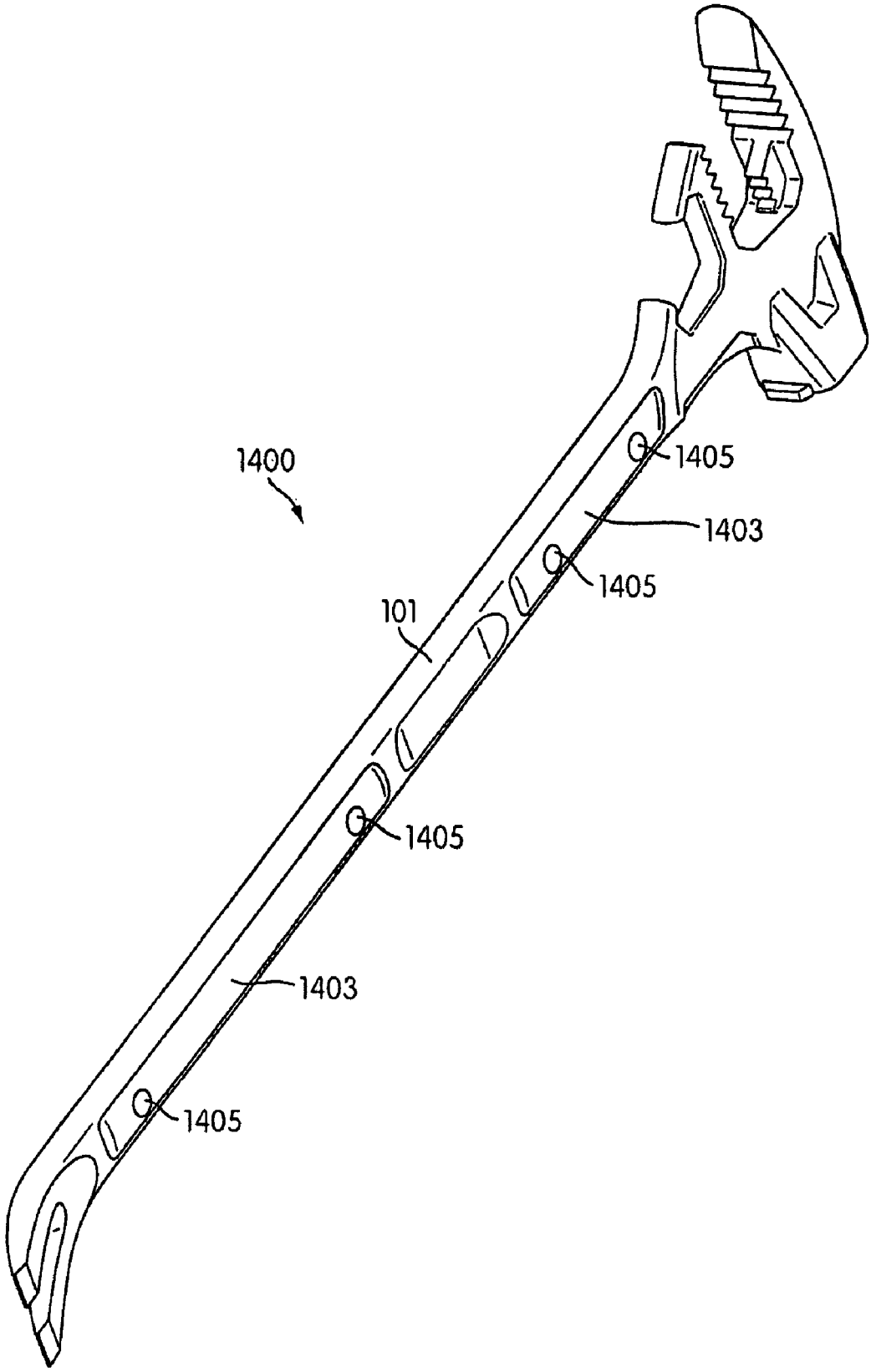
FIG. 16 illustrates a perspective view of a demolition tool according to an embodiment of the invention.

In some embodiments, recessed portions along the handle of a demolition tool may accept different types of inserts. FIG. 14 illustrates inserts 1403 that may be secured into recesses 1401 of demolition tool 1400. In some embodiments, inserts 1403 may be secured into recesses 1401 using one or more fasteners 1405. In some embodiments, a fasteners 1405 such as, for example, a screw, rivet, or other fastener, may be placed through a hole 1407 in an insert 1403 and a hole 1409 in recess 1401 so as to fasten insert 1403 into recess 1401. In some embodiments, other methods such as, for example, adhesive, may be used to secure inserts 1403 to recesses 1401. FIGS. 15 and 16 illustrate demolition tool 1400 wherein inserts 1403 are secured to recesses 1401. FIG. 11 also illustrates inserts 1109 secured to handle 101 via fasteners 1111.

Inserts 1403 may provide various functions. For example, in some embodiments, inserts 1403 may be molded from one or more types of plastic or rubber that provide increased grip and/or comfort for a user of a demolition tool. In some embodiments, inserts 1403 may be made from a material (e.g., plastic, rubber, or other material) that provides impact or shock cushioning for a user's hands. In some embodiments, a plurality of differentially indicated inserts 1403 may be available for use with a demolition tool so that demolition tools may be distinguished from one another or otherwise customized. For example, inserts 1403 may be differentially indicated by color, texture, custom text (e.g., "Joe's demolition tool"), or other differential indicator to customize or otherwise distinguish one demolition tool from another. In some embodiments, inserts 1403 may be made from a material that resists heat transfer from the handle to the hands of a user (e.g., certain plastics, rubber, or other material). For example, a firefighter using a demolition tool of the invention may encounter surfaces which are hot. As such, heat transfer resistant inserts 1403 may aid the firefighter in performing demolition or other duties during the course of an emergency. Heat transfer resistant inserts 1403 may also be useful in other situations.

In some embodiments, inserts 1403 may be made from a luminescent (e.g. a chemi-luminescent) material, a phosphorescent material, or a light reflective material that enables demolition tool 1400 and/or its user to be located in low light or no light situations.

In some embodiments, inserts may be made from a material that provides any one or more of comfort grip, shock absorption, differential indication, heat transfer resistance, electrical shock insulation, luminescence, light reflection, and/or other features.

In one embodiment, it is contemplated that FIGS. 1-16 are drawn to scale (i.e., not to actual size, but in proportion).

While the invention has been described with reference to the certain illustrated embodiments, the words that have been used herein are words of description, rather than words of limitation. Changes may be made, within the purview of the associated claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the associated claims.

What is claimed is:

1. A multi-use demolition tool, comprising:

a) an elongated handle;

b) a head at one end of the handle, the head including a first side and a second side opposite the first side, the first side of the head including a contact surface, the second side including spaced grasping jaws, the spaced grasping jaws including an upper jaw having teeth and a lower jaw having teeth, wherein the teeth on the upper jaw are generally parallel with the teeth on the lower jaw;

c) at least three surface portions shaped and arranged to engage correspondingly shaped and arranged surfaces of a pentagonal fastener, the at least three surface portions being located on the head and formed in the lower jaw, below the teeth on the lower jaw;

d) an arc-shaped spanner wrench portion that includes a protrusion spaced a first distance from the elongated handle such that the arc-shaped spanner wrench portion is arranged to receive an outer surface of a fire hose clamp and such that the protrusion is arranged to engage a hose protrusion of a hose clamp, wherein the spanner wrench portion is located on the head below the contact face; and e) a slot that comprises two parallel surfaces spaced to engage a shut-off element of a gas shut-off valve.

2. The multi-use demolition tool of claim 1, wherein an opening formed by the spaced grasping jaws extends generally perpendicularly to the contact surface.

3. The multi-use demolition tool of claim 1, wherein the head includes a central longitudinal plane, the multi-use demolition tool further comprising a bent end pry bar comprising a forked end located at the second end of the handle, wherein the two parallel surfaces of the slot are located on the forked end, and wherein the bent end pry bar is bent in a direction that is 90 degrees offset from the central longitudinal plane of the head.

4. The multi-use demolition tool of claim 1, wherein the head includes a central longitudinal plane, the multi-use demolition tool further comprising a bent end pry bar located at a second end of the handle, wherein the bent end pry bar is bent in a direction that is 90 degrees offset from the central longitudinal plane of the head.

5. The multi-use demolition tool of claim 4, wherein the bent end pry bar comprises a forked end.

6. The multi-use demolition tool of claim 4, wherein the forked end includes two arms and wherein the two arms comprise the two parallel surfaces of the slot.

7. The multi-use demolition tool of claim 6, wherein the slot has a width of 0.5 inches.

8. The multi-use demolition tool of claim 1, wherein the handle includes one or more elongated recesses formed therein, wherein at least one of the one or more recesses include an insert secured therein, the insert increasing visibility of the handle in low light environments.

9. The multi-use demolition tool of claim 8, wherein the insert comprises one or more of a grip-enhancing material, a shock absorbent material, a heat transfer resistant material, a luminescent material, or a light reflective material.

10. The multi-use demolition tool of claim 8, wherein the insert includes a differential indicator that distinguishes the multi-use demolition tool from other multi-use demolition tools.

11. The multi-use demolition tool of claim 10, wherein the differential indicator includes one or more of a color or text.

12. A multi-use demolition tool, comprising:

a) an elongated handle having one or more elongated recesses formed therein, wherein at least one of the one or more recesses include an insert secured therein, the insert increasing visibility of the handle in low light environments;

b) a head at one end of the handle, the head including on a first side thereof a contact surface, and on a second side thereof, opposite the first side, spaced grasping jaws, the spaced grasping jaws including an upper jaw having teeth and a lower jaw having teeth, wherein the teeth on the upper jaw are generally parallel with the teeth on the lower jaw, and wherein an opening formed by the spaced grasping jaws faces generally the opposite direction as the contact surface; and c) a pentagonal fastener engagement portion, the engagement portion comprising at least three, but less than five surface portions shaped and arranged to engage at least three, but less than five, sides of a pentagonal fastener, wherein the surface portions are formed in the lower jaw, below the teeth on the lower jaw.

13. A multi-use demolition tool, comprising:

a) an elongated handle having one or more elongated recesses formed therein, wherein at least one of the one or more recesses include an insert secured therein, the insert increasing visibility of the handle in low light environments;

b) a head at one end of the handle, the head having a central longitudinal plane, the head including a first side and a second side opposite the first side, the first side of the head including a contact surface, the second side including spaced jaws, wherein an opening formed by the spaced jaws extends generally perpendicularly to the contact surface and wherein the spaced jaws include an upper jaw having teeth and a lower jaw having teeth, and wherein the teeth on the upper jaw are generally parallel with the teeth on the lower jaw;

c) at least three surface portions shaped and arranged to engage correspondingly shaped and arranged surfaces of a pentagonal fastener, the at least three surface portions being located on the head and formed in the lower jaw, below the teeth on the lower jaw;

d) an arc-shaped spanner wrench portion that includes a protrusion spaced a first distance from the elongated handle such that the arc-shaped spanner wrench portion is arranged to receive an outer surface of a fire hose clamp and such that the protrusion is arranged to engage a hose protrusion of a hose clamp, wherein the spanner wrench portion is located on the head below the contact face; and e) a bent end pry bar comprising a forked end located at the second end of the handle, wherein the forked end includes two parallel surfaces spaced to engage a shut-off element of a gas shut-off valve, and wherein the bent end pry bar is bent in a direction that is 90 degrees offset from the central longitudinal plane of the head.

* * * * *